United States Patent [19]

Levin

[11] 4,253,704

[45] Mar. 3, 1981

[54] METHOD AND APPARATUS FOR DISINTEGRATING A MATERIAL

[76] Inventor: Igor A. Levin, Petrozavodskaya ulitsa, 15, korpus 1, kv. 113, Moscow, U.S.S.R.

[21] Appl. No.: 974,231

[22] Filed: Dec. 29, 1978

[51] Int. Cl.[3] ..... E21C 37/18

[52] U.S. Cl. ..... 299/14; 37/DIG. 18; 173/117; 241/1; 241/262; 310/26; 299/69

[58] Field of Search ..... 299/14, 69, 70; 175/16, 175/56, 105; 241/1, 262; 310/317, 365–368, 26; 37/DIG. 18; 172/40; 173/117

[56] References Cited

U.S. PATENT DOCUMENTS

| | | | |
|---|---|---|---|
| 2,825,534 | 3/1958 | Reid | 175/105 |
| 2,831,668 | 4/1958 | Skowronski | 175/56 X |
| 2,834,158 | 5/1958 | Petermann | 310/317 X |
| 2,858,108 | 10/1958 | Wise et al. | 175/56 |
| 2,859,952 | 11/1958 | La Tour et al. | 299/14 |
| 3,181,799 | 5/1965 | Wurzburg et al. | 241/1 |
| 3,274,540 | 9/1966 | Melhart | 310/26 X |
| 3,511,323 | 5/1970 | Riley | 175/56 X |
| 3,558,907 | 1/1971 | Jensen | 173/117 X |

*Primary Examiner*—Ernest R. Purser
*Attorney, Agent, or Firm*—Holman & Stern

[57] ABSTRACT

A method for disintegrating a material comprises acting on the material being disintegrated with shock waves produced upon applying individual electromagnetic field pulses to a current-conducting element arranged in a close proximity to the material being disintegrated. An apparatus for disintegrating a material comprises a unit forming electromagnetic field pulses connected to a current source and arranged in a close proximity to the current-conducting element.

23 Claims, 13 Drawing Figures

METHOD AND APPARATUS FOR DISINTEGRATING A MATERIAL

FIELD OF THE ART

The invention relates to the art of disintegrating materials by crushing, and more specifically deals with method and apparatus for disintegrating a material.

The method and apparatus according to the invention may be most advantageously used for crushing caked or frozen together granular cargoes in railway open cars before unloading, for disintegrating frozen together or caked granular materials in various hoppers, as well as in making excavations in frozen and rock soils for the purposes of construction. The invention may also be used for comminution of ores and various products, for crushing oversized rocks in the mining industry, in the construction and power production industries.

BACKGROUND OF THE INVENTION

At present frozen together or caked granular materials in railway open cars are crushed before unloading by uniformly loosening the cargo over the full height of the open car (cf. D. I. Segal, "Loading and Unloading Equipment" (in Russian), Znamya Publishers, Moscow, 1976, pp. 26–27).

This method is, however, rather inefficient and requires large time and labour consumption. Apparatus for carrying out this method are cumbersome, complicated and exhibit high power requirements.

Known in the art in an apparatus for crushing oversized lumps of ore and rocks, comprising a casing accommodating a spring-loaded work tip (hammer) driven by hydraulic or pneumatic system. The apparatus may also be used for loosening and disintegrating caked or frozen together granular materials in railway open cars (cf. USSR Inventor's Certificate No. 340,447, Cl B02C 1/12, 1970).

Known in the art is a loosening excavator, comprising a loosening column provided with a work tip, and a vibratory mechanism comprising a double-action cylinder, vibratory impact impulses alternately acting on both the loosening column and work tip (cf. USSR Inventor's Certificate No. 371,320, Cl. E02f (5/30, 1970).

Known in the art is an apparatus for excavating hard rocks, comprising an excavating machine with a working member having teeth provided with pneumatic hammers (cf. USSR Inventor's Certificate No. 65,948, Cl. E02f 5/30, 1945).

All above-described apparatus are complicated, exhibit low efficiency and have limited field of application.

Better results are provided by a method for disintegrating a material involving application thereto of impulse shock waves induced by an explosion. Upon an explosion, a compression sawtooth wave propagates through the material. The disturbance incident on the exposed boundary of the material is reflected therefrom in the form of a tension wave. Superposition of the incident compression wave and reflected tension wave results in disintegration of the material (cf. J. S. Reinchart and J. Pearson, "Explosive Treatment of Metals" (transl. from English), Mir Publishers, Moscow, 1966, pp. 168–175).

The disadvantage of this prior art method resides in complicated realization thereof and high danger for the personnel performing the explosion operations.

Most perfect and efficient among prior art apparatus is a bulldozer for excavating frozen soil and rocks by an explosion method. The bulldozer comprises a working member mounted to a carrier vehicle. The working member incorporates combustion chambers and a exhaust pipe having its open end extending through holes provided in the working surface of the working member. The working member has work bits secured to a piston rod caused to move under the action of gases formed in the combustion chamber upon combustion of fuel mix. During the movement of the piston, the work bit connected thereto accomplishes the work to disintegrate the soil. At the same time, the gases leaving the exhaust pipes loosen the soil being treated and throw it away from the working surface of the working member thereby facilitating penetration of the working member into the soil.

This apparatus is deficient in complicated structure, high energy consumption and low efficiency when working in rocks.

SUMMARY OF THE INVENTION

The main object of the invention is to provide method and apparatus for disintegrating a material which enable most efficient disintegration of various materials, including rocks and oversized lumps of rock, within minimum power requirements from external energy source and in minimum time.

The invention resides in that in a method for disintegrating a material comprising acting thereon with shock waves, according to the invention, a current-conducting element arranged in a close proximity to the surface of the material being disintegrated is deformed by applying thereto individual electromagnetic field pulses.

The current-conducting element is preferably deformed by applying thereto at least one train of individual electromagnetic field pulses.

The length of electromagnetic field pulse preferably ranges from $10^{-5}$ to $10^{-2}$ s, and the ratio of the pause between successive electromagnetic field pulses to the length of electromagnetic field pulse ranges from 10 to 10000.

The invention also resides in that in an apparatus for disintegrating a material, comprising means for disintegrating a material, according to the invention, said means includes at least one unit forming electromagnetic field pulses, which is connected, via a switch made, for example, as a thyristor, to a current source having an energy storage means and is arranged in a close proximity to the current-conducting element, a control electrode of the thyristor being connected to a switching circuit.

At least two adjacent units forming electromagnetic field pulses are preferably connected in series and form a group connected to the current source via a thyristor having its control electrode connected to a switching circuit.

At least one group of units forming electromagnetic field pulses and the current-conducting element may be arranged on a wall of a container with the material being disintegrated.

At least one unit forming electromagnetic field pulses and the current-conducting element may be arranged on the inner side of the working surface of a working member of an excavating machine.

At least one group of units forming electromagnetic field pulses and the current-conducting element may be arranged on the inner side of the working surface of a working member of an excavating machine.

One unit forming electromagnetic field pulses and the current-conducting element may be arranged on the exposed surface of the material being disintegrated.

At least one group of units forming electromagnetic field pulses and the current-conducting element are preferably arranged on the exposed surface of the material being disintegrated.

At least one unit forming electromagnetic field pulses and the current-conducting element may be arranged on a movable jaw of a crusher.

At least one group of units forming electromagnetic field pulses and the current-conducting element are preferably arranged on a movable jaw of a crusher.

At least one unit forming electromagnetic field pulses and the current-conducting element may be arranged on a work bit which is movable relative to the unit forming electromagnetic field pulses and to the current-conducting element.

At least one group of units forming electromagnetic field pulses and the current-conducting element are preferably arranged on a work tip which is movable relative to the group of units forming electromagnetic field pulses and to the current-conducting element.

An arm mounting the unit forming electromagnetic field pulses is preferably made of a dielectrical material.

The unit forming electromagnetic field pulses preferably comprises an inductance coil arranged in a dielectrical casing accomodating a current-supply member feeding current to the inductance coil.

The current-supply member preferably comprises a rod having one end connected to the inductance coil and accomodated in a dielectrical casing, the other end of the rod being provided with nuts.

The invention enables a considerable reduction of average input by accumulating energy in the energy storage means during pauses between successive pulses.

Power $N_1$ of a pulse is determined as follows:

$$N_1 = N_2 \cdot \eta (t + T/t),$$

wherein $N_2$ is the power capacity of energy source, $\eta$ is the efficiency of the apparatus, t is the pulse length T is the pause between successive pulses, $$10 \leqq (T/t) \leqq 10000.$$

Thus, with the pulse length of e.g. $1.10^{-3}$ s, the pause between successive pulses 1 s and the efficiency of 90%, the average input is 900 times smaller than the pulse power.

Furthermore, the invention enables an improvement of the efficiency of disintegration of a material and provides for high productivity.

BRIEF DESCRIPTION OF THE DRAWINGS

The invention will now be described with reference to specific embodiments illustrated in the accompanying drawings, in which.

DETAILED DESCRIPTION OF THE INVENTION

Figure 1:
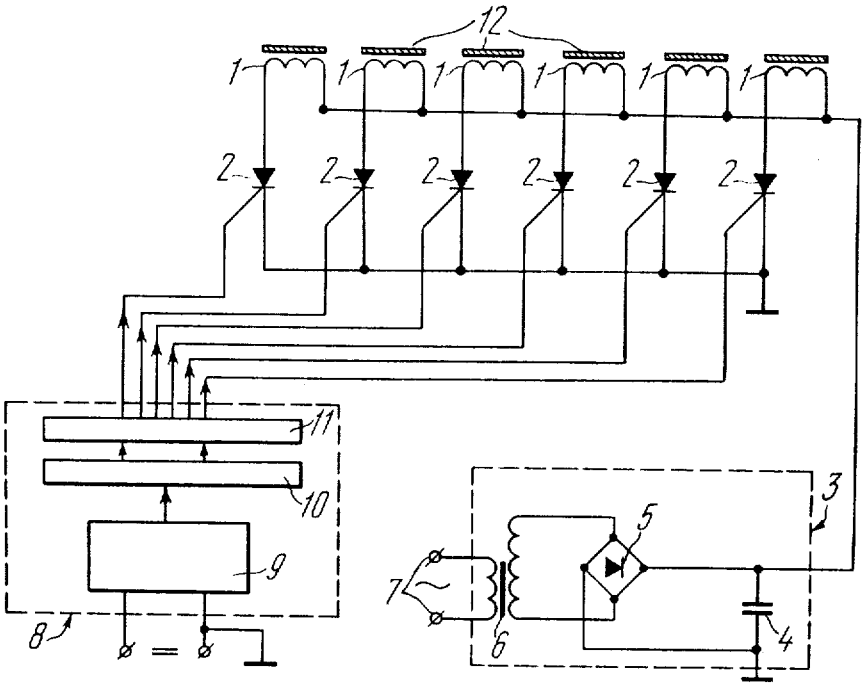
FIG. 1 shows an electric circuit of an apparatus for disintegrating a material, ensuring an independent drive of units forming electromagnetic field pulses, according to the invention.

An apparatus for disintegrating a material comprises units 1 (FIG. 1) forming electromagnetic field pulses connected, via switches made, for example, as thyristors 2 to a current source 3 having an electric energy storage means 4. The current source also has a rectifier converter 5 inserted between the electric energy storage means 4 and a step-up transformer 6 having its primary winding connected to supply voltage terminals 7. Control electrodes of the thyristors 2 are connected to a switching circuit 8. The switching circuit 8 comprises a series circuit including a pulse generator 9, a ring shift register 10 and a pulse amplifier 11.

The unit 1 is arranged in a close proximity to a current-conducting element 12 which is preferably made of a highly electrically conductive material, such as aluminium or copper.

Figure 2:
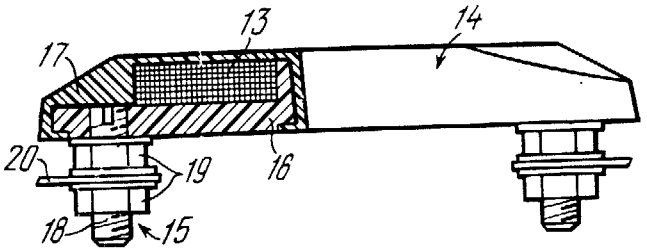
FIG. 2 shows a structural embodiment of the unit forming electromagnetic field pulses, according to the invention.

The unit 1 comprises an inductance coil 13 (FIG. 2) arranged in a dielectrical casing 14 having a current-supply member 15 for feeding current to the coil 13.

The casing 14 comprises a frame 16 on which the coil 13 is wound, and an envelope 17. The current-supply member 15 comprises a rod 18 having one end which is press-fitted in the frame 16 and connected to the coil 13, the other end of the rod being provided with nuts 19. A terminal 20 mounted between the nuts 19 is used to supply the inductance coil 13 with current. The rod 18 and nuts 19 are used for mounting the unit 1.

Figure 3:
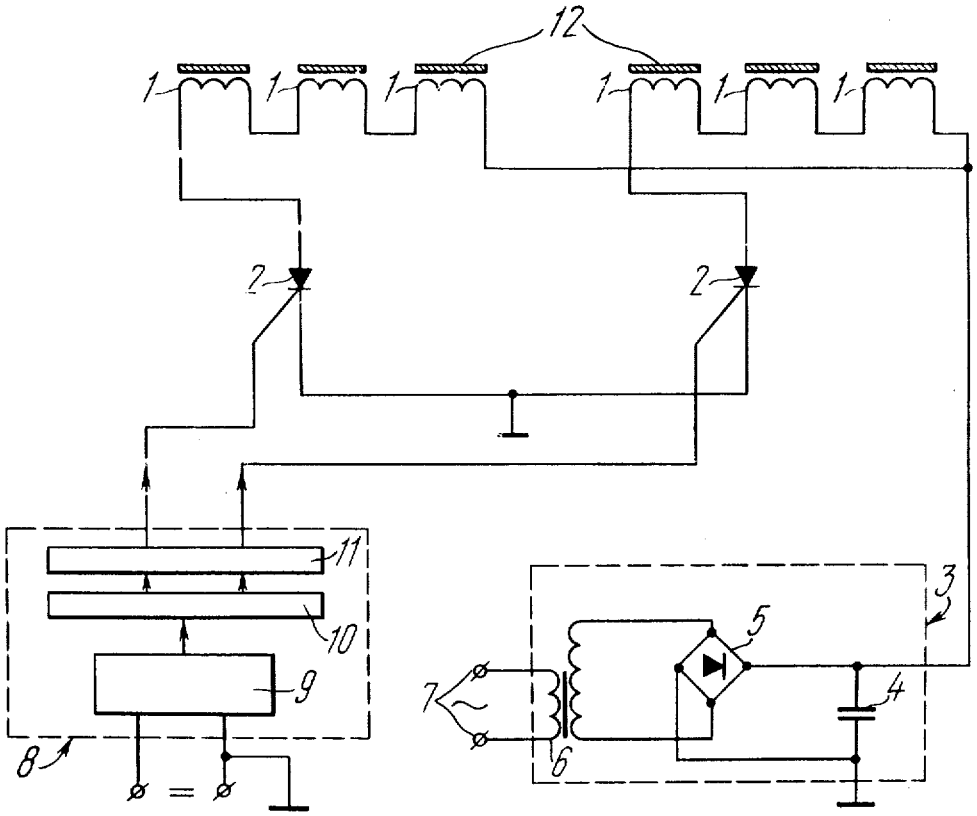
FIG. 3 shows an electric circuit of an apparatus for disintegrating a material, ensuring a simultaneous drive of units forming electromagnetic field pulses, united into groups, according to the invention.

FIG. 3 shows an embodiment of the apparatus wherein three adjacent units 1 are connected in series and form a group connected to the current source 3 via the thyristor 2.

Various possible applications of the apparatus for disintegrating a material will be described below.

Figure 4:
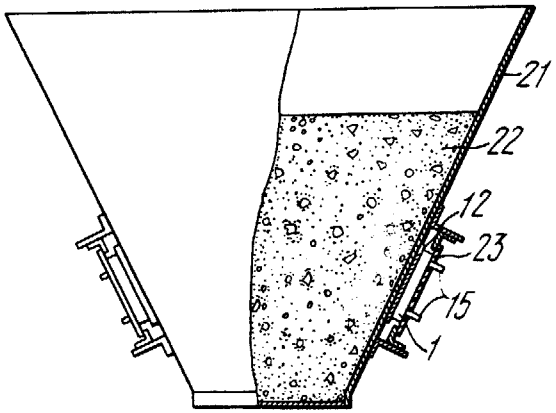
FIG. 4 is a partial longitudinal section of a container with the material being disintegrated, showing the units forming electromagnetic field pulses with current-conducting elements, according to the invention.

FIG. 4 shows an embodiment of the apparatus for disintegrating a material confined within in a closed space.

The unit 1 forming electromagnetic field pulses and the current-conducting element 12 are arranged on a wall 21 of a container with the material 22 being disintegrated.

The container may be in the form of a railway open car or a hopper containing frozen together or caked granular material.

The unit 1 is secured to the wall 21 by means of an arm 23 made of a dielectrical material.

Figure 5:
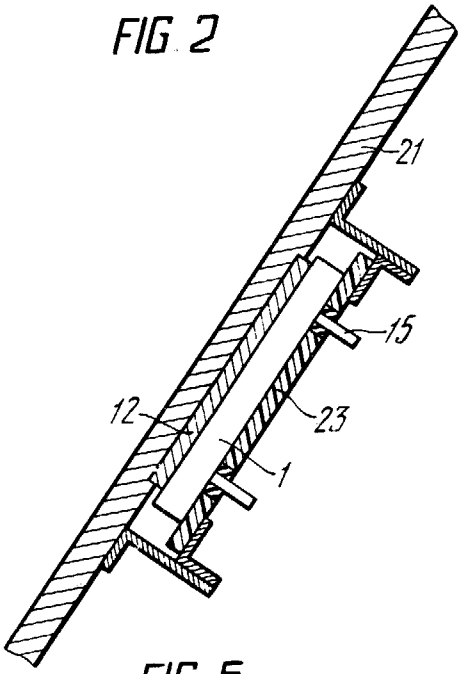
FIG. 5 is a partial longitudinal section showing a wall of a container and a unit forming electromagnetic field pulses and a current-conducting element, according to the invention.
Figure 6:
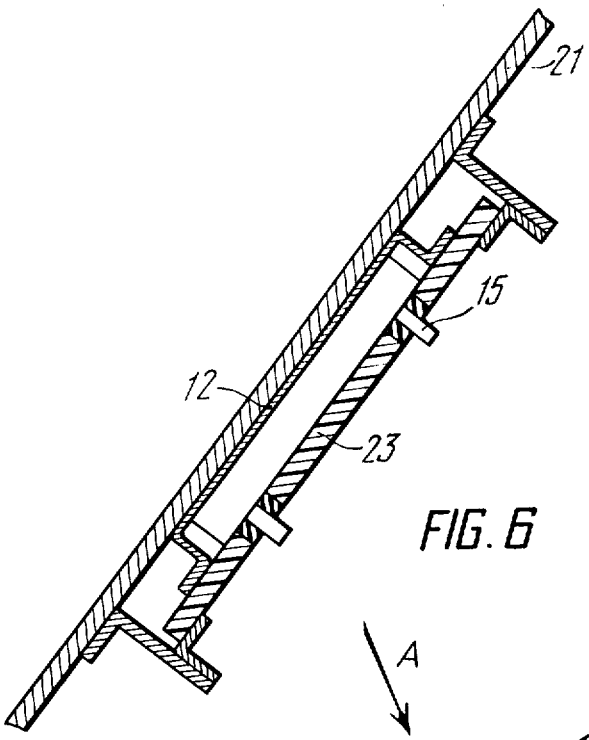
FIG. 6 is a longitudinal section showing a wall of a container and a unit forming electromagnetic field pulses with a current-conducting element, according to the invention.

The current-conducting element 12 may be secured to the wall 21 (FIG. 5) of the container by means of the arm 23 (FIG. 6) and may be arranged between the wall 21 (FIG. 4) and the unit 1 without any fastening. In the latter case, the current-conducting element 12 is held against the wall 21 owing to the arm 23 pressing the unit 1 against the wall 21.

In case the wall 21 of the container is made of an electrically conducting material, the current-conducting element 12 may be dispensed with.

Figure 7:
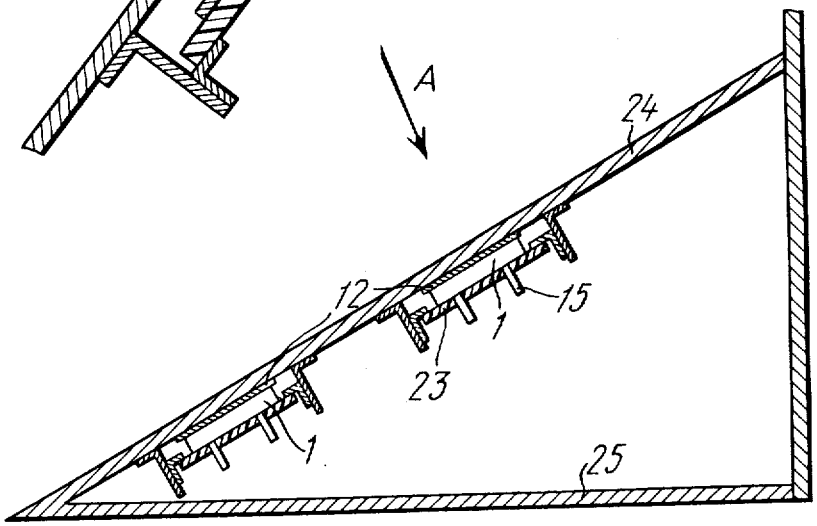
FIG. 7 is a longitudinal section showing a working member of an excavating machine and units forming electromagnetic field pulses with a current-conducting element according to the invention.

FIG. 7 shows two units 1 and the current-conducting elements 12 arranged on the inner side of the working surface 24 of a working member 25 of an excavating machine. The units 1 are secured to the working surface 23 as described above.

Figure 8:
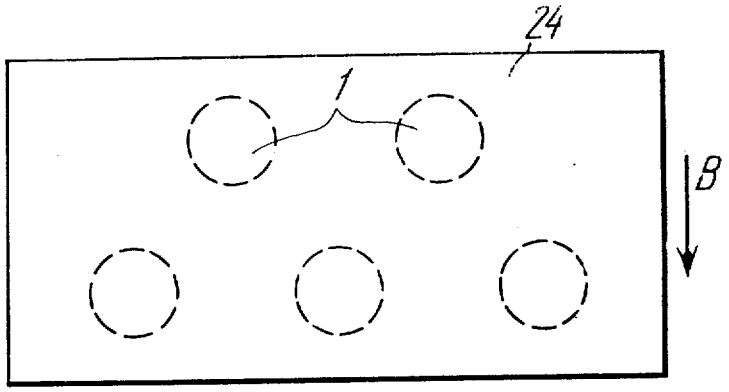
FIG. 8 is a view taken along arrow A in FIG. 7 of a working member of an excavating machine and units forming electromagnetic field pulses, according to the invention.

FIG. 8 shows a view of the working member 25 of an excavating machine taken along arrow A. The units 1 are united into groups extending in parallel with one another in the direction at right angle to the direction of movement of the working member 25. The direction of movement of the working member 25 is shown by arrow B in the Figure.

The units 1 of one group are staggered relative to the units of the other group.

Figure 9:
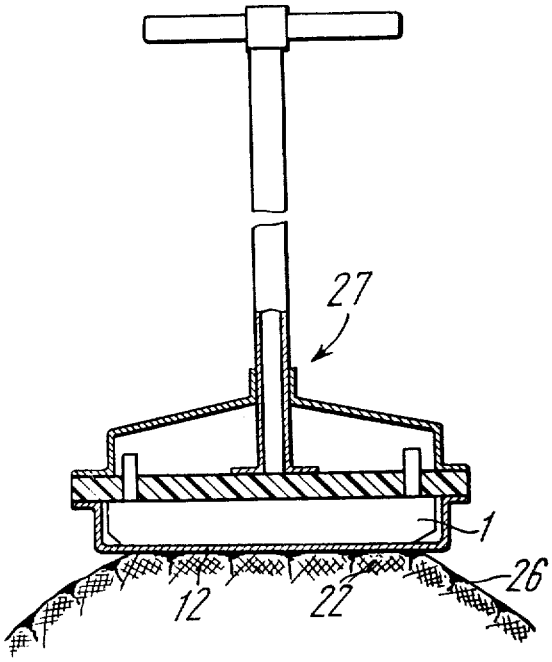
FIG. 9 is a longitudinal section schematically showing the material being disintegrated having an exposed surface, and a unit forming electromagnetic field pulses with a current-conducting element, according to the invention.

FIG. 9 shows an embodiment of the apparatus in an application for soil disintegration. The unit 1 and the current-conducting element 12 are arranged on the exposed surface 26 of the material 22 being disintegrated. The unit 1 and the current-conducting element 12 are held against the exposed surface 26 by means of a mounting member 27.

For manual disintegration of a material, only one unit 1 is preferably used, so that a light-weight portable tool for disintegrating a material may be provided.

Figure 10:
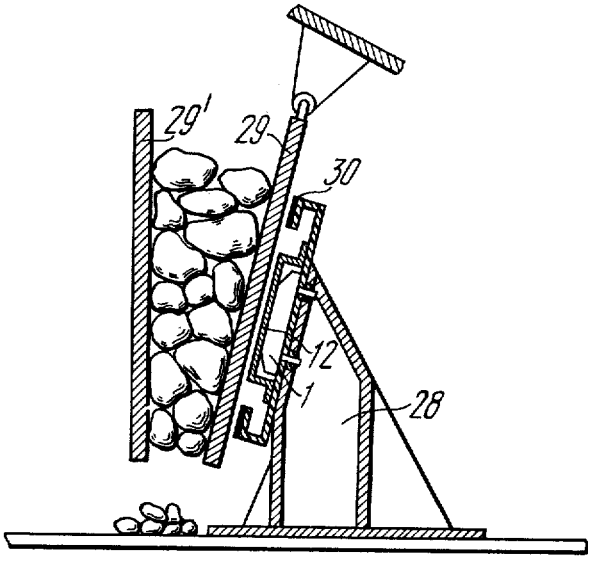
FIG. 10 is a longitudinal section showing a crusher having movable and stationary jaws, and a unit forming electromagnetic field pulses with a current-conducting element, according to the invention.

FIG. 10 shows an embodiment of the apparatus used in a jaw crusher for disintegrating a material. The unit 1 and the current-conducting element 12 are secured to a rigid support 28 and arranged on a movable jaw 29 of the crusher which is movable relative to the unit 1 and a stationary jaw 29' of the crusher.

To prevent the jaw 28 and the current-conducting element 12 from hitting one another, there is provided a stop 30 limiting the displacement of the jaw 28.

Figure 11:
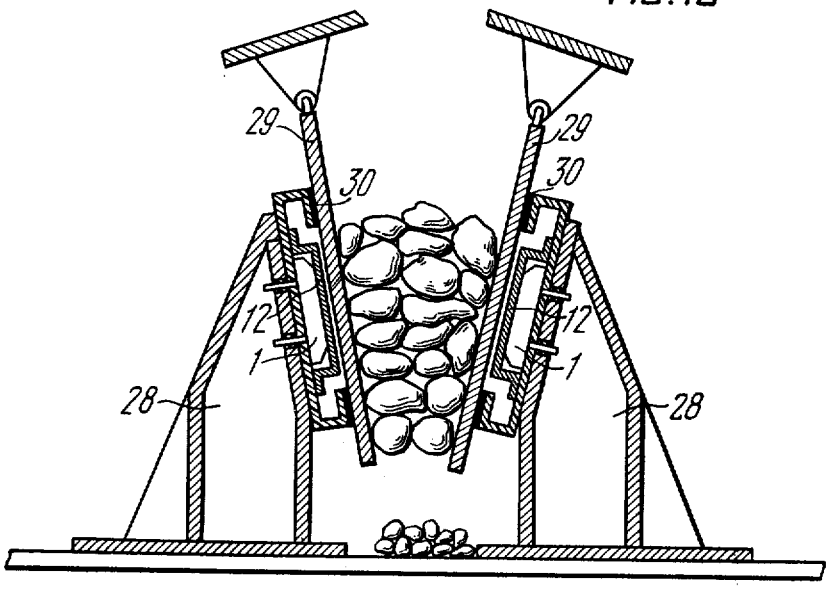
FIG. 11 is a longitudinal section showing a crusher with two movable jaws and units forming electromagnetic field pulses with current-conducting elements, according to the invention.

In case the apparatus is used in a crusher having two movable jaws, the unit 1 and the current-conducting element 12 are arranged on both jaws 29 of the crusher (FIG. 11).

In an application where the mounting member 27 is secured to a vehicle, a group of units 1 is preferably used.

Figure 12:
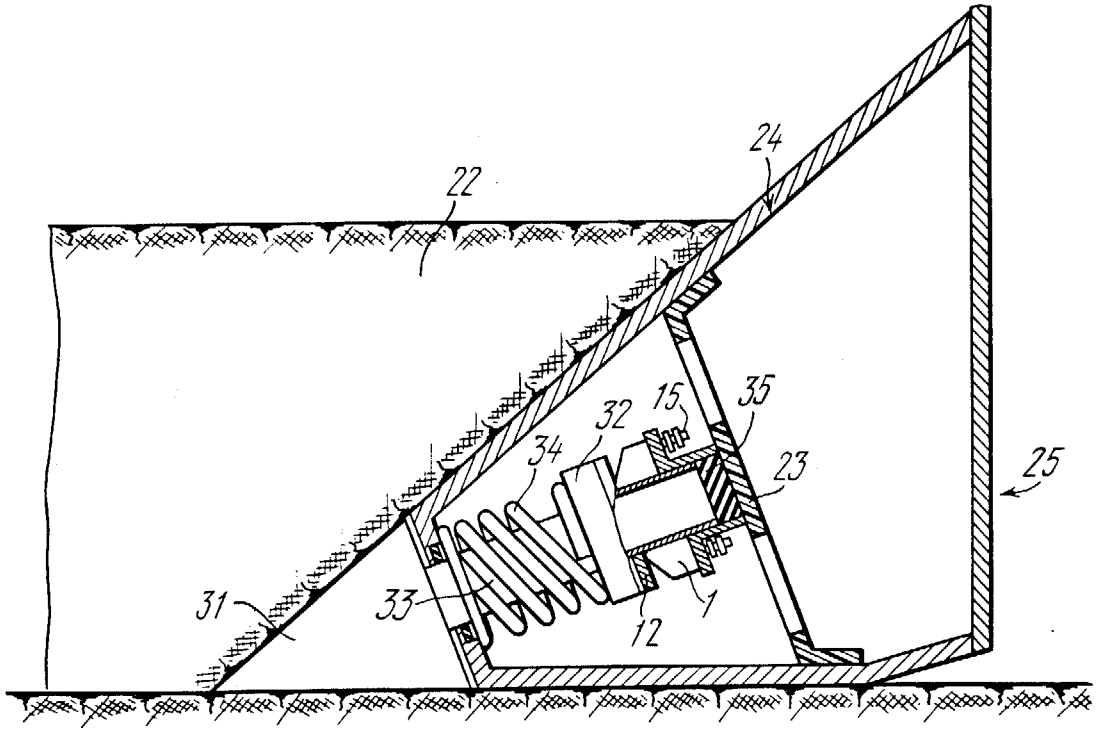
FIG. 12 is a longitudinal section showing an excavating machine with a work bit, and a unit forming electromagnetic field pulses with a current-conducting element, according to the invention.

FIG. 12 shows an embodiment of the apparatus as applied to an excavating machine having a work bit.

The unit 1 and the current-conducting element 12 are arranged on a work bit 31 which is movable relative to the unit 1 and to the current-conducting element 12.

The unit 1 is secured by means of an arm 23 to the inner side of the working surface 24 of the working member 25 of an excavating machine, and the current-conducting element 12 is arranged between the unit 1 and a piston 32 of a piston rod 33 connected to the work bit 31. A spring 34 is installed between the wall of the working member 25 and the piston 32. To prevent the piston 32 from hitting against the unit 1, a shock absorber 35 made of an elastic material, such as rubber, is provided between the arm 23 and the piston rod 33.

In case the working member 25 has a plurality of the work bits 31, the above-described elements are used for each work bit. To synchronize operation of the work bits, the units 1 are preferably connected into respective groups.

Figure 13:
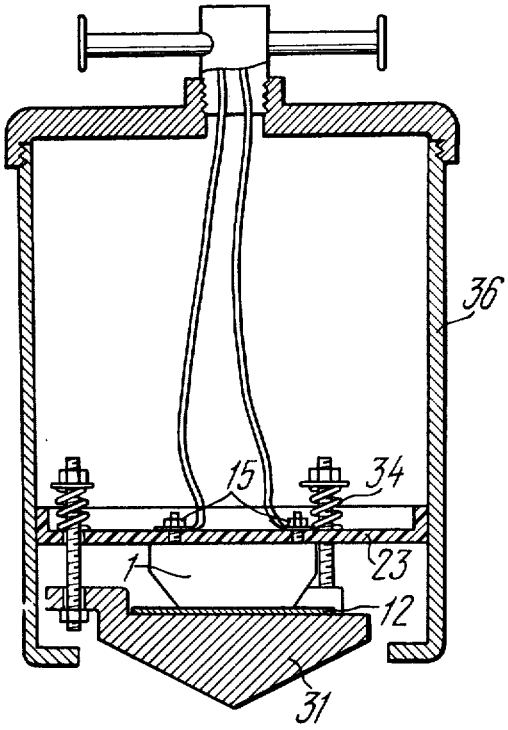
FIG. 13 is a longitudinal section showing a portable tool with a work bit and a unit forming electromagnetic field pulses with a current-conducting element, according to the invention.

FIG. 13 shows an embodiment of the apparatus having a work bit, which can be used as a portable tool.

The unit 1 is secured by means of the arm 23 in a casing 36 and is arranged in a close proximity to the work bit 31 secured to the arm 23 by means of an elastic suspension, such as the spring 34 so that the work bit 31 may move relative to the unit 1.

The current-conducting element 12 is arranged between the unit 1 and the work bit 31.

In case the work bit 31 is made of an electrically conducting material, the current-conducting element 12 may be dispensed with. In applications where the apparatus for disintegrating a material according to the invention is used on excavating machines, the current source 3 (FIG. 3) is preferably installed on the machine.

In case the apparatus for disintegrating a material according to the invention is used as a portable tool, the current source 3 is preferably a stationary current source, or it may be installed on an auxiliary vehicle.

The apparatus for disintegrating a material functions in the following manner.

When a supply voltage is applied from the current source 3 to the terminals 7 (FIG. 1), the electric energy storage means 4 is charged through the step-up transformer 6 and the rectifier converter 5. When a signal is fed from the switching circuit 8 to the control electrode of one of the thyristors 2, the thyristor becomes conductive, and the storage means 4 is discharged into the unit 1 connected to a given thyristor 2. The discharge current pulse flowing in the unit 1 comprising the inductance coil 13 (FIG. 2) generates an electromagnetic field pulse which induces in the current-conducting element 12 (FIG. 1) a secondary pulse current. When the discharge current pulse flowing in the unit 1 interacts with the induced pulse current in the current-conducting element 12, the latter is deformed and abruptly repelled from the unit 1. As a result, individual shock waves are emitted into the depth of the material being disintegrated to cause the appearance of ultimate stresses in the material. To enlarge the zone of impact action, several units 1 are used. In this example six units are used to form electromagnetic field pulses, which are connected to the current source 3 in a sequence set-up by the switching circuit 8.

For simultaneous drive of several units 1 (FIG. 3), they are united into groups controlled by one thyristor 2 so that the zone of simultaneously applied ultimate stresses is enlarged. FIG. 3 shows an embodiment of the apparatus for disintegrating a material using two groups each containing three units 1, and the current-conducting element 12 consists of three parts each being arranged in a close proximity to a respective unit 1. The switching circuit 8 (FIG. 1) controls the drive of the units 1 in a pre-set sequence. A pulse generator 9 produces a continuous sequence of voltage pulses fed to the ring shift register 10 and then amplified in the amplifier 11.

Before starting operation, a logical one is stored in the first place off the ring shift register 10. Logical zeroes appear in all remaining places, and the thyristor 2 associated with the first place of the shift register 10 becomes conductive. Upon receiving a first pulse from the pulse generator 9, the logical one is transferred to the second place, that is upon receiving the second pulse from the generator 9, the thyristor 2 associated with the second place of the shift register 10 becomes conductive, and the logical one is transferred to the next place.

The electromagnetic field pulse length ranges from $10^{-5}$ to $10^{-2}$ s so that a large range of conditions for efficient disintegration of materials is ensured. Amplitude of the impulse action depends on the electromagnetic field pulse length and increases with reduction of the pulse length. With the pulse length above $10^{-2}$ s, the efficiency of disintegration of the material abruptly decreases.

With the pulse length below $10^{-5}$ s technical difficulties arise associated with the production and application of such pulse.

The ratio of the pause between successive electromagnetic field pulses to the pulse length ranges from 10 to 10000 and is optimal for high efficiency of disintegration and reduction of power requirements. The ratio above 1000 results in an unwarranted increase in the time needed for final disintegration of the material. Reduction of the ratio below 10 results in an increase in the power requirements as the storage means 4 would have to be charged for a short time to its rated value.

The operation of the apparatus for disintegrating a material will be described for various applications.

The apparatus installed on the wall 21 (FIG. 4) of the container with the material 22 being disintegrated functions in the following manner.

Upon interaction of the discharge current pulse flowing in the unit 1 with the induced pulse current in the current conducting element 12, the current-conducting element 12 is abruptly repelled together with the wall 21. The zone of the wall 21 in contact with the current-conducting element 12 is elastically deformed and acts with the shock wave of the material 22 being disintegrated. The process of disintegrated. The process of disintegration of the material confined in a closed space is intensified owing to the appearance of opposite reflected waves due to the interference of the waves.

When a group of simultaneously driven units 1 is used to disintegrate the material in the container the effect of disintegration of the material due to the interference of waves becomes stronger.

The apparatus arranged on the inner side of the working surface 24 of the working member 25 of an excavating machine functions in such a manner as to transmit through the working surface 24 of the working member of an excavating machine an impact action provided owing to the interaction of the discharge current pulse flowing in the unit 1 with the induced pulse current in the current-conducting element 12.

Operation of the apparatus arranged on the exposed surface of the material being disintegrated resides in creating ultimate stresses on the surface 26 of the material 22 being disintegrated as a result of action of shock waves appearing upon interaction of the discharge current pulse flowing in the unit 1 with the induced pulse current in the current-conducting element 12.

When the apparatus for disintegrating a material is used in a jaw crusher, a shock wave provided as a result of interaction of the discharge current pulse flowing in the unit 1 with the induced pulse current in the current-conducting element 12 is transmitted to the movable jaw 29 (FIG. 10) of the crusher which is abruptly repelled from the unit 1 secured to the rigid support 28, the material between the movable jaw 29 and stationary jaw 29' of the crusher being disintegrated.

To make the effect of disintegration of material stronger, both jaws 29 of the crusher are made movable (FIG. 11), and each jaw has the unit 1 and the current-conducting element 12. Impact actions are applied to both jaws simultaneously towards one another.

Operation of the apparatus for disintegrating a material when used in an excavating machine having a work bit resides in the following.

During interaction of the discharge current pulse flowing in the unit 1 (FIG. 12) with the induced pulse current in the current-conducting element 12, the current-conducting element 12 is abruptly repelled from the unit 1. As a result, an impact action is produced which is transmitted through the piston 32 and piston rod 33 to the work bit 31. The work bit 31 is displaced to penetrate the material 22 being disintegrated. The work bit 31 is returned back by means of the spring 34.

When the apparatus for disintegrating the material is used in a portable tool, the operation is as described for application in an excavating machine having a work bit.

The invention enables a considerable reduction of average input since during the pauses between successive pulses of electromagnetic field, having the length 10–1000 times greater than the pulse length, electric energy is accumulated in the storage means 4 and is then consumed for the next pulse, and the invention also ensures an improved efficiency of the process of disintegration of a material and high productivity.

The method and apparatus for disintegrating a material are simple, do not require considerable capital investments, while minimum number of movable components in the apparatus provides for high reliability.

What is claimed is:

1. A method for disintegrating a material comprising acting on said material with shock waves produced by deforming a metal current-conducting element arranged in close proximity to the surface of said material being disintegrated by electro-magnetically inducing individual current pulses through said current-conducting element.

2. A method according to claim 1 comprising deforming the current-conducting element by a synchronous group of individual electromagnetic field pulses.

3. A method according to claim, 2 wherein the electromagnetic field pulse length ranges from $10^{-5}$ to $10^{-2}$ seconds, and the ratio of the pause between successive electromagnetic field pulses to the electromagnetic field pulse length ranges from 10 to 10000.

4. An apparatus for disintegrating a material comprising:

a switching circuit;

a current source;

a metal current-conducting element which deforms when a current pulse is passed therethrough;

at least one thyristor switch;

means for securing said current-conducting element in close proximity to said material;

at least one unit for forming electromagnetic field pulses connected, via said thyristor, to said current source and arranged in close proximity to said current-conducting element; a control electrode of said thyristor being connected to said switching circuit to alternatively render said thyristor conductive and non-conductive thereby passing current pulses from said source through said unit and inducing current pulses in said current-conducting element.

5. An apparatus according to claim 4 comprising:

a further current-conducting metal element which deforms when a current pulse is passed therethrough, said further element being secured in close proximity to said material;

a further unit forming electromagnetic field pulses connected in series with said first-mentioned unit and connected to said current source via said thyristor and arranged in close proximity to said further current-conducting element.

6. An apparatus according to claim 5, comprising at least one group of said units forming electromagnetic field pulses and said current-conducting element which are arranged on a wall of a container with said material being disintegrated.

7. An apparatus according to claim 5, comprising at least one group of said units forming electromagnetic field pulses and a current-conducting element which are arranged on the inner side of the working surface of a working member of an excavating machine.

8. An apparatus according to claim 5, comprising at least one group of units forming electromagnetic field pulses and the current-conducting element which are arranged on the exposed surface of said material being disintegrated.

9. An apparatus according to claim 5, comprising at least one group of units forming electromagnetic field pulses and the current-conducting element which are arranged on a movable jaw of a crusher.

10. An apparatus according to claim 5, comprising at least one group of units forming electromagnetic field pulses and the current-conducting element which are arranged on a work bit which is movable relative to said group of said units forming electromagnetic field pulses and to said current-conducting element.

11. An apparatus according to claim 4, wherein at least one unit forming electromagnetic field pulses and said current-conducting element are arranged on a wall of a container for said material being disintegrated.

12. An apparatus according to claim 4 comprising at least one said unit forming electromagnetic field pulses and said current-conducting element arranged on the inner side of the working surface of a working member of an excavating machine.

13. An apparatus according to claim 4, comprising at least one said unit forming electromagnetic field pulses and the current-conducting element arranged on the exposed surface of said material being disintegrated.

14. An apparatus according to claim 4, comprising an arm for mounting said unit forming electromagnetic field pulses; said arm being made of a dielectrical material.

15. An apparatus according to claim 14, comprising:

a dielectrical casing;

a current-supply member;

said unit forming electromagnetic field pulses comprising an inductance coil arranged in said dielectrical casing accommodating said current-supply member feeding current to said inductance coil.

16. An apparatus according to claim 15, comprising said current-supply member in the form of a rod; one end of said rod being connected to said inductance coil and arranged in said dielectrical casing; nuts provided at the other end of said rod.

17. An apparatus for disintegrating a material comprising:

a switching circuit;

a current source;

a metal current-conducting element which deforms when a current pulse is passed therethrough and which is mounted proximate said material;

at least one thyristor;

at least one unit forming electromagnetic field pulses connected, via said thyristor, to said current source and arranged in close proximity to said current-conducting element; a control electrode of said thyristor being connected to said switching circuit to alternatively render said thyristor conductive and non-conductive, thereby passing current pulses from said source through said unit and inducing current pulses in said current-conducting element;

at least one said unit forming electromagnetic field pulses and said current-conducting element being arranged on a movable jaw of a crusher.

18. An apparatus according to claim 17, comprising:

a current-supply member;

a dielectrical casing;

said unit forming electromagnetic field pulses comprising an inductance coil arranged in said dielectrical casing accommodating said current-supply member feeding current to said inductance coil.

19. An apparatus according to claim 18, comprising said current-supply member in the form of a rod, one end of said rod being connected to said inductance coil and arranged in said dielectrical casing; nuts provided at the other end of said rod.

20. An apparatus for disintegrating a material comprising:

a switching circuit;

a current source;

a metal current-conducting element which deforms when a current pulse is passed therethrough and which is mounted proximate said material;

at least one thyristor;

at least one unit forming electromagnetic field pulses connected, via said thyristor, to said current source and arranged to close proximity to said current-conducting element; a control electrode of said thyristor being connected to said switching circuit to alternatively render said thyristor conductive and non-conductive, thereby passing current pulses from said source through said unit and inducing current pulses through said current-conducting element;

at least one said unit forming electromagnetic field pulses and said current-carrying element being arranged on a work bit which is movable relative to said unit forming electromagnetic field pulses and to said current-conducting element.

21. An apparatus according to claim 20, comprising:

a dielectrical casing;

a current-supply member;

said unit forming electromagnetic field pulses comprising an inductance coil arranged in said dielectrical casing accommodating said current-supply member feeding current to said inductance coil.

22. An apparatus according to claim 21, comprising said current-supply member in the form of a rod; one end of said rod being connected to said inductance coil and arranged in said dielectrical casing; nuts provided at the other end of said rod.

23. An apparatus for disintegrating a material comprising:

a current source;

a switching circuit;

at least one thyristor;

a metal current-conducting element which deforms in response to a current pulse passed therethrough;

at least two adjacent units forming electromagnetic field pulses connected in series and forming a group connected to said current source via said thyristor; a control electrode of said thyristor connected to said switching circuit;

said group of said units being arranged in a close proximity to said current-conducting element;

an arm for mounting said group of said units;

said arm being made of a dielectrical material.

* * * * *